US005490671A

United States Patent [19]

Picard

[11] Patent Number: 5,490,671

[45] Date of Patent: Feb. 13, 1996

[54] TARGET GOLD COURSE AND GAME

[76] Inventor: Roy W. Picard, P.O. Box 89, North Turner, Me. 04266

[21] Appl. No.: 429,190

[22] Filed: Apr. 26, 1995

[51] Int. Cl.[6] ..... A63B 67/02

[52] U.S. Cl. ..... 273/176.4

[58] Field of Search ..... 273/176 R, 176 A, 273/176 AB, 176 B, 176 E, 176 F, 176 FA

[56] References Cited

U.S. PATENT DOCUMENTS

| | | | |
|---|---|---|---|
| 3,526,405 | 9/1970 | Morris | 273/181 R |
| 3,649,027 | 3/1972 | Vallas | 273/176 A |
| 4,019,748 | 4/1977 | Healey | 273/176 AB |
| 4,145,053 | 3/1979 | Healey | 273/176 AB |
| 4,215,865 | 8/1980 | Pilati | 273/176 FA |
| 4,696,474 | 9/1987 | Tegart | 273/176 A |
| 4,928,973 | 5/1990 | Perry et al. | 273/176 A |
| 4,934,704 | 6/1990 | Mazer | 273/176 F |
| 4,988,105 | 1/1991 | Perry et al. | 273/176 A |
| 5,016,884 | 5/1991 | Psiol et al. | 273/176 FA |
| 5,213,330 | 5/1993 | Benson | 273/176 A |
| 5,370,389 | 12/1994 | Reising | 273/35 B |
| 5,431,402 | 7/1995 | Aguilera | 273/176 AB |

FOREIGN PATENT DOCUMENTS

| | | |
|---|---|---|
| WO92/18208 | 10/1992 | WIPO . |
| WO93/01871 | 2/1993 | WIPO . |
| WO94/12250 | 6/1994 | WIPO . |

*Primary Examiner*—William H. Grieb
*Attorney, Agent, or Firm*—Richard C. Litman

[57] ABSTRACT

A target golf course and game including long and short distance holes, a sand and pitch shot hole, a chip and putt hole, and a putting course to finish up a round of golf. A scoring system of play includes methodology wherein a higher score is indicative of success rather than a lower score as is the case in a conventional golf game. A "target score" replaces par. The entire course of eight holes can be laid out on about 22 acres compared with the 60 acres or so required for a conventional nine hole golf course. Nonetheless, about 42 to 46 shots will be required of most players, which is about what a player could expect in playing a conventional nine hole round of golf. An uncomplicated but attractive and novel score card is employed. This new game provides for golf shot distances from 300 yards to tap in putting with chip and trap shots included. The scoring system includes the play of two balls by each player on each hole except for the putting course where each player plays a single ball, a higher score being awarded for distance or accuracy as appropriate.

16 Claims, 5 Drawing Sheets

TARGET GOLD COURSE AND GAME

BACKGROUND OF THE INVENTION

1. Field of the Invention

The present invention relates to the game of golf and, more particularly, to a target golf course and game with distinct scoring.

2. Description of the Prior Art

The present invention provides not only a novel golf course which is compact in size yet challenging in play, but also a new and distinct golf scoring game wherein a higher score is indicative of a good game, rather than a lower score as in the conventional game of golf. Furthermore, a scoring system and scorecard provides additional totals of long, intermediate and short game shots so that the player may fairly assess his or her skills and readily determine what, if any, areas need attention for improvement.

The course and game of the present invention are configured and designed to enable a player to hit a wide variety of clubs, including drivers, fairway woods, long, middle and short irons, pitching irons, chippers and putters. Distances of up to 300 yards and down to tap-in putts all come into play with a novel scoring system that evaluates and scores each shot and even provides an indication of areas of the game that may need work and improvement.

The relevant prior art includes a number of disclosures related to variations of the classic game of golf, including games of target golf. For example, U.S. Pat. No. 3,649,027 issued Mar. 14, 1972, to Theodore L. Vallas, discloses a target golf course and game wherein a highly standardized and confined layout is provided, with all tee positions confined to one end of the course. The provision of separate holes and the scoring system of the instant invention are absent from the Vallas patent. As for prior art which might be relevant to the bullseye targets of the instant invention, a pitch and putt practice apparatus including a concentric ringed target, elevated at one end and tilted toward the player, is seen in U.S. Pat. No. 3,526,405 issued Sep. 1, 1970, to George H. Morris. However, the varied course and complete game layout of the instant invention is not taught at all be Morris.

Another compact golf course including separate chipping and putting areas, but without the multiple hole targets and scoring system of the instant invention, is taught in U.S. Pat. No. 4,696,474 issued Sep. 29, 1987, to Harold G. Tegart. Other somewhat relevant prior art disclosures of compact or arena style golf courses are seen in WIPO published patent application Nos. WO 92/18208 published Oct. 29, 1992, Gordon Sirola, inventor, and WO 94/12250 published Jun. 9, 1994, Jeffrey Sargeant, inventor. Both the course layouts and game played as taught by each of these disclosures are remote from standard golf while the instant invention, although designed only to supplement standard golf, not replace it, nevertheless more closely approximates the feel and rhythm of conventional play. Another compact golf course with separate holes of varying distance, but with very narrow, side by side, strictly rectangular fairways, is taught in WIPO published patent application No. WO 93/01871 published Feb. 4, 1993, Henry A. Rhodes, inventor.

More remote prior art teachings and disclosures are found in the following patents. An electronically enhanced golfing range game provided with multiple tees but only a single teeing area and including a visual display for indicating the player's score is disclosed in U.S. Pat. No. 5,370,389 issued Dec. 6, 1994, to Douglas J. Reising. Cage type structures for the practice of a variety of golf shots or putting only are taught in U.S. Pat. Nos. 4,215,865 issued Aug. 5, 1980, to Oliver H. Pilati, and 5,016,884, issued May 21, 1991, to Nick Psiol et al., respectively.

None of the above inventions and patents, taken either singly or in combination, is seen to describe the instant invention as claimed.

SUMMARY OF THE INVENTION

Accordingly, it is a principal object of the invention to provide a target golf course and game of compact size and configuration but allowing for all the variety of shots encountered on a standard, conventional golf course.

It is another object of the invention to provide a target golf course and game which is played outdoors, but requires far less acreage for layout of the course and allows a full game to be played in about an hour and a half.

It is a further object of the invention to provide a target golf course and game with a novel scoring system in which each player plays with two balls on each hole and receives a higher score for distance/accuracy rather than a lower score as in a conventional game of golf.

Still another object of the invention is to provide a target golf course and game with a scoring system and card which provides not only a total score but a breakdown score indicative of proficiency in the long game, intermediate game and short game.

It is an object of the invention to provide improved elements and arrangements thereof in a golf course and game arrangement for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a restricted size, compact golf course and novel game of golf which provides the excitement and challenges of the conventional golf game, yet requires far less acreage for the course layout, can be played completely in about ninety minutes, and provides a scoring methodology wherein a higher rather than a lower score is indicative of a successful round of golf, in direct contradistinction to a conventional golf game.

Figure 3:
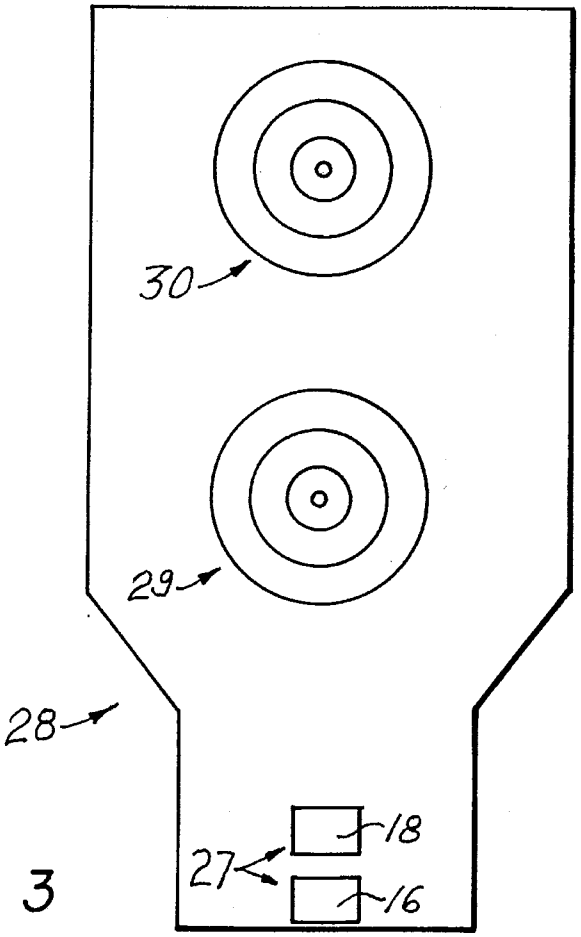
FIG. 3 is a top plan view of a 100 yard and 50 yard target hole according to the invention.

The target golf course layout of the present invention is designed and configured to be set up on about 22 acres of land, as compared with the 60 acres or more of land required for a conventional nine hole golf course, and includes eight distinct holes, including an eighth, putting course green having five holes on this course. The first three holes, best seen at the left hand side of FIG. 1 and in enlarged scale in FIG. 2, include men's and ladies' tee areas, the former about twenty-five yards behind the latter, a target area for long, drive shots, and a closer-in bullseye target for shorter shots, e.g., fairway wood or iron shots. The fourth hole, shown at the upper right of FIG. 1 and in FIG. 3, is a short distance hole, with two bullseye targets positioned about fifty and one hundred yards, respectively, from the back teeing area.

Figure 4:
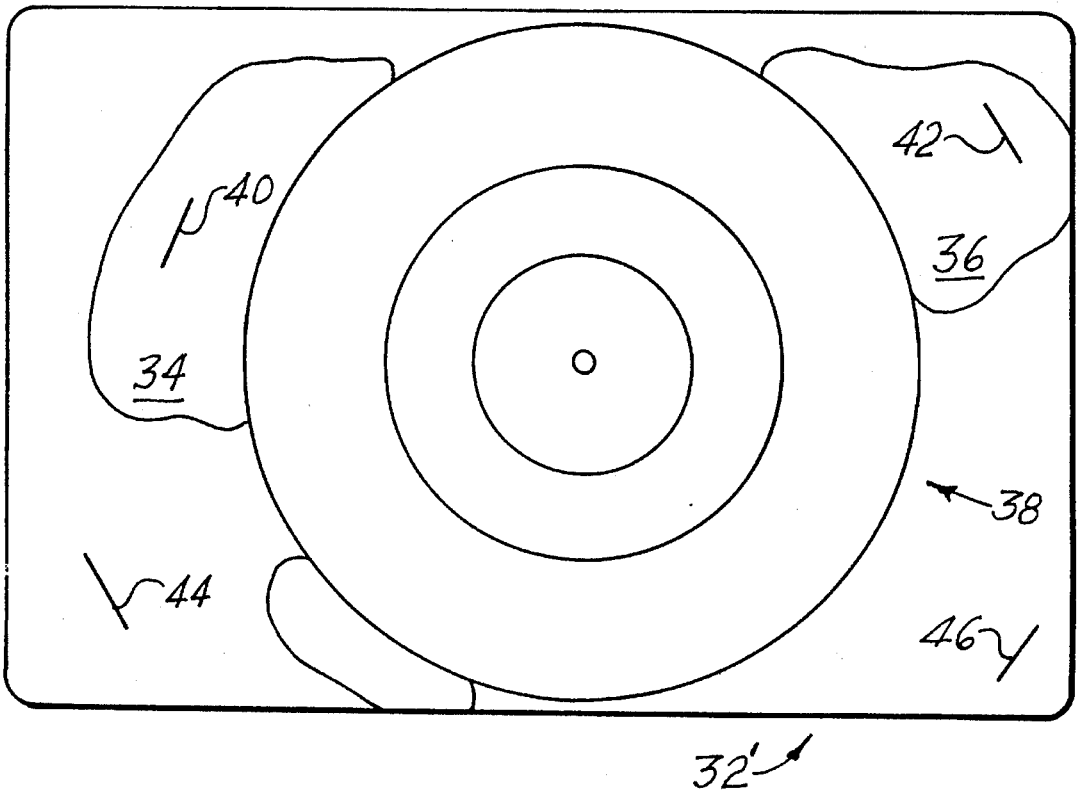
FIG. 4 is a top plan view of a sand and pitch shot hole according to the invention.
Figure 6:
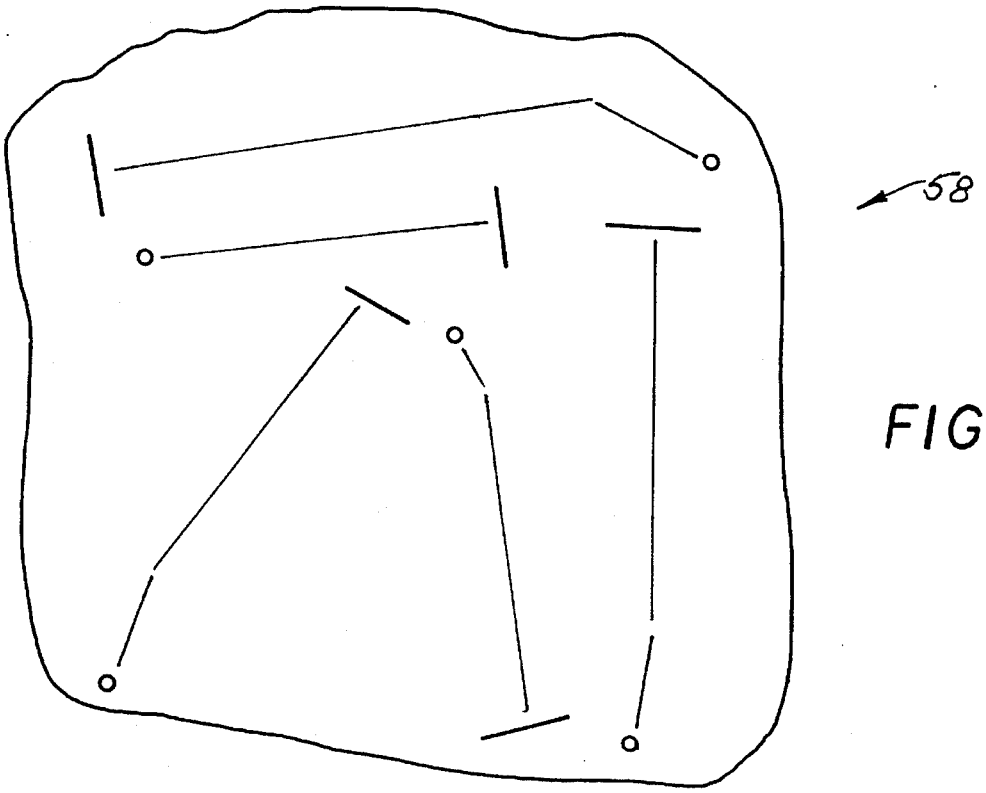
FIG. 6 is a top plan view of a putting course according to the invention.
Figure 5:
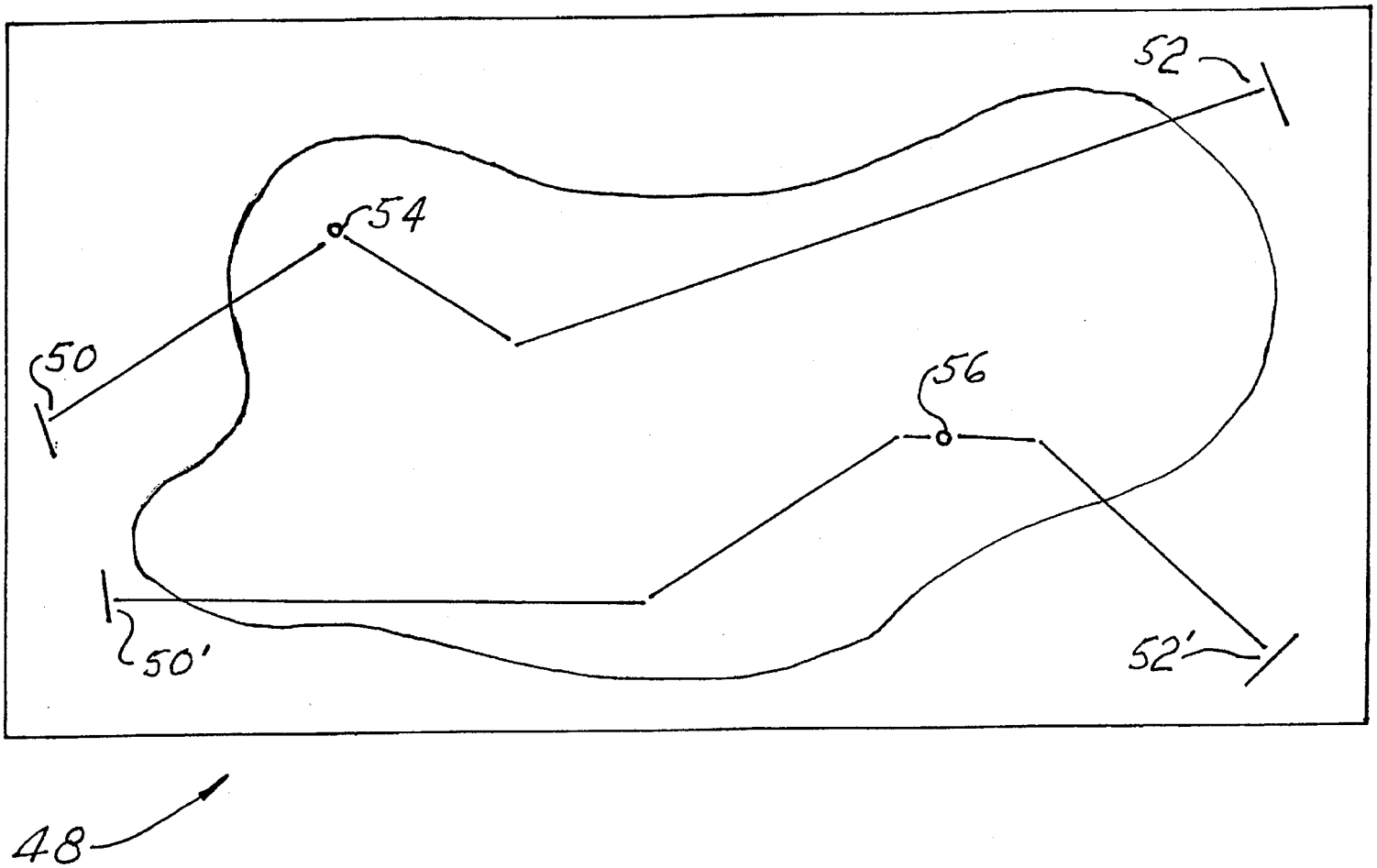
FIG. 5 is a top plan view of a chip and putt hole according to the invention.

A fifth hole, seen below the fourth hole in FIG. 1, includes a pair of teeing areas and a short distance bullseye target. The sixth hole, seen below the fifth in FIG. 1, and drawn to an enlarged scale in FIG. 4, is a sand and pitch shot hole including two demarcated positions for sand shots and two additional positions for pitch shots, onto a central, target bullseye. The seventh hole, shown beneath the sixth hole in FIG. 1, and drawn to an enlarged scale in FIG. 5, is a chip and putt hole with two pairs of shot positions and a green with two holes, one for each pair of shot positions. Finally, the eighth hole, seen at the bottom right in FIG. 1 and in FIG. 6, is a putting course with, preferably, five holes and five putting positions, ranging from a fairly long putt to a tap-in putt.

Figure 7:
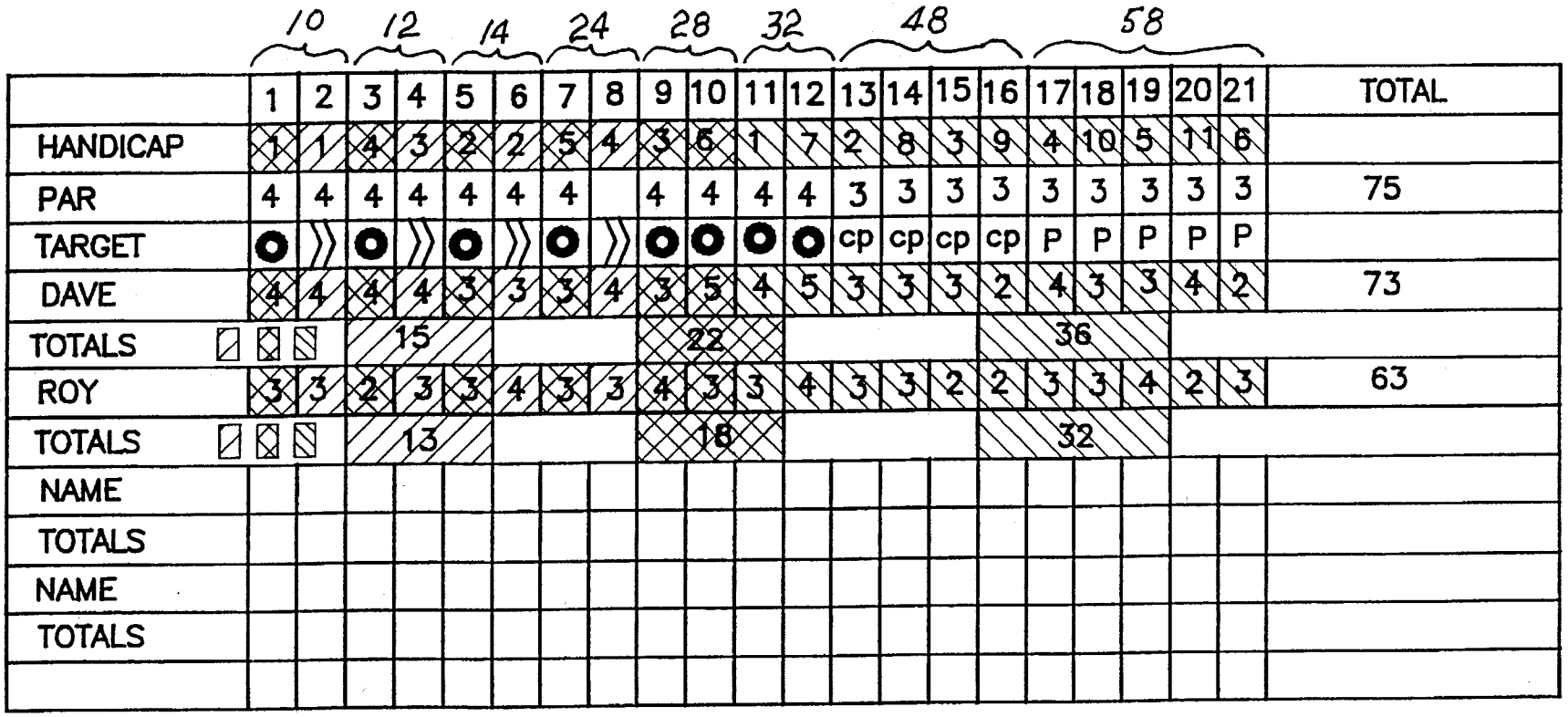
FIG. 7 is a plan view of a score card used with play and the game according to this invention.

A unique scoring system is provided and recorded on a score card, seen in FIG. 7. Total score for each player may be shown together with total shots for the long game, intermediate game, and short game, whereby each player may fairly assess his or her skills and note those areas, if any, needing work or improvement.

A more specific description of the instant invention follows. With particular reference to FIGS. 1 and 2, the target golf course of the instant invention is seen as being made up of a distinct variety and number of holes. Play begins on the first three holes 10, 12 and 14, each of similar configuration, varying in distance, and designed for long ball play. Each includes men's and ladies' teeing areas 16 and 18, respectively, the former being located about 25 yards or so behind the latter. As can be seen in FIG. 2, each teeing area 16 and 18 includes two tee positions, 16A, 16B and 18A and 18B, respectively. Each player plays each of these holes with four balls, two toward the far target area and two toward the bullseye target area. The first two balls are hit for distance, toward a target area 20, configured in chevron fashion. The farther the ball is driven, the greater the score. Additionally, a score for great distance and accuracy is provided, there being a hole-in-one location 21 in the more distant region of the chevron target area 20. In a preferred scoring method, a player would score 4 for hitting the hole-in-one location 21, 3 for hitting the far chevron region around location 21, 2 for hitting a shot to the next closer region, and 1 for hitting the chevron area closest to the tee areas 16, 18. As stated above, each player will have two shots to chevron target area 20, and par can be 2 for each shot, or 4 for the total of the two shots.

Next, the player would hit two shorter distance shots to the more restricted width area of the hole, aiming for the bullseye target 22, from the same tee positions 16A, 16B or 18A, 18B. Here, accuracy is more important than distance but the scoring is the same as for the chevron target area 20. A hole-in-one 23 for a score of 4 is provided, with a shot to the first ring scoring 3, the next ring 2, and the outermost ring 1. Par is established at 2 for each shot, in a preferred scoring method, for a total of 4 for the two shots.

With further reference to FIG. 2, an additional, fourth hole 24 could be provided, similar in nature and configuration to the first three holes 10, 12 and 14, but of shorter range with the bullseye target 22 being about 125 yards from the men's tee 16. Play, scoring and par would be the same as is the case with the first three holes. This additional fourth hole 24 could supplement or supplant a second, short distance hole 26, shown to the right in FIG. 1, and which is explained in detail hereinbelow. Turning now to the upper right hand portion of FIG. 1 and with specific reference to FIG. 3, a relatively short distance, double bullseye hole 28 is provided. The tee areas 27 may be side by side as shown in FIG. 1, or, preferably, one behind the other as shown in FIG. 3, thus providing men's and ladies'tees 16, 18, respectively. The targets 29 and 30 are distanced about 50 and 100 yards from the tees, respectively. Play, scoring and par are the same as in the case of the previously explained bullseye targets 22, with two balls hit by each player to each target 29, 30.

As a further variation where real estate is at an especially high premium, the first four long holes 10, 12, 14, 24, could be reduced to two long holes, for example, with two bullseye targets positioned one behind the other with respect to the tee area, and with a consequent doubling up of strokes and scores. More specifically, each player would hit four long shots on each of the two holes, and two shots to the far bullseye target, and, finally, two shots to the closer in bullseye target.

The single bullseye hole 26 may be provided or eliminated as desired, in initial course planning and construction. Play, scoring and par would be the same as with hole 28, except, of course, each player would hit only two balls, as only a single bullseye target is provided.

With reference to the next hole 32, seen in greater detail as hole 32' in FIG. 4, this is a sand and pitch shot hole, where the short iron game is best tested. Two sand traps 34, 36 are positioned adjacent a bullseye hole 38, with two shot positions 40, 42, being demarcated, respectively. Additionally, two pitch positions 44, 46 are provided. Each player will hit four balls toward the hole, one from each position 40, 42, 44, 46. Scoring is as above, with 4 scored for a hole-in-one, 3 for landing in the ring adjacent the hole, 2 for landing in the next ring, and 1 for landing in the outermost ring. The target or par score will be a total of 8, or 2 for each shot.

Again with reference to FIG. 1 and now with reference to FIG. 5, a chip-and-putt hole 48 (numbered 48' in FIG. 5) is provided immediately beneath the hole 32. With detailed reference to FIG. 5, two pairs of chip positions 50, 52, 50', 52' are provided, one pair for each hole 54, 56, respectively, and all four chip positions are used by each player; that is, each player hits one ball from each position. If the player holes out, 4 is the score. A chip plus one putt results in a score of 3, a chip plus two putts results in 2, and a chip plus one putt results in 1. Par is 3 plus 3 (for each position, or, stated more accurately, 3 for each ball) for a total of 12.

Figure 1:
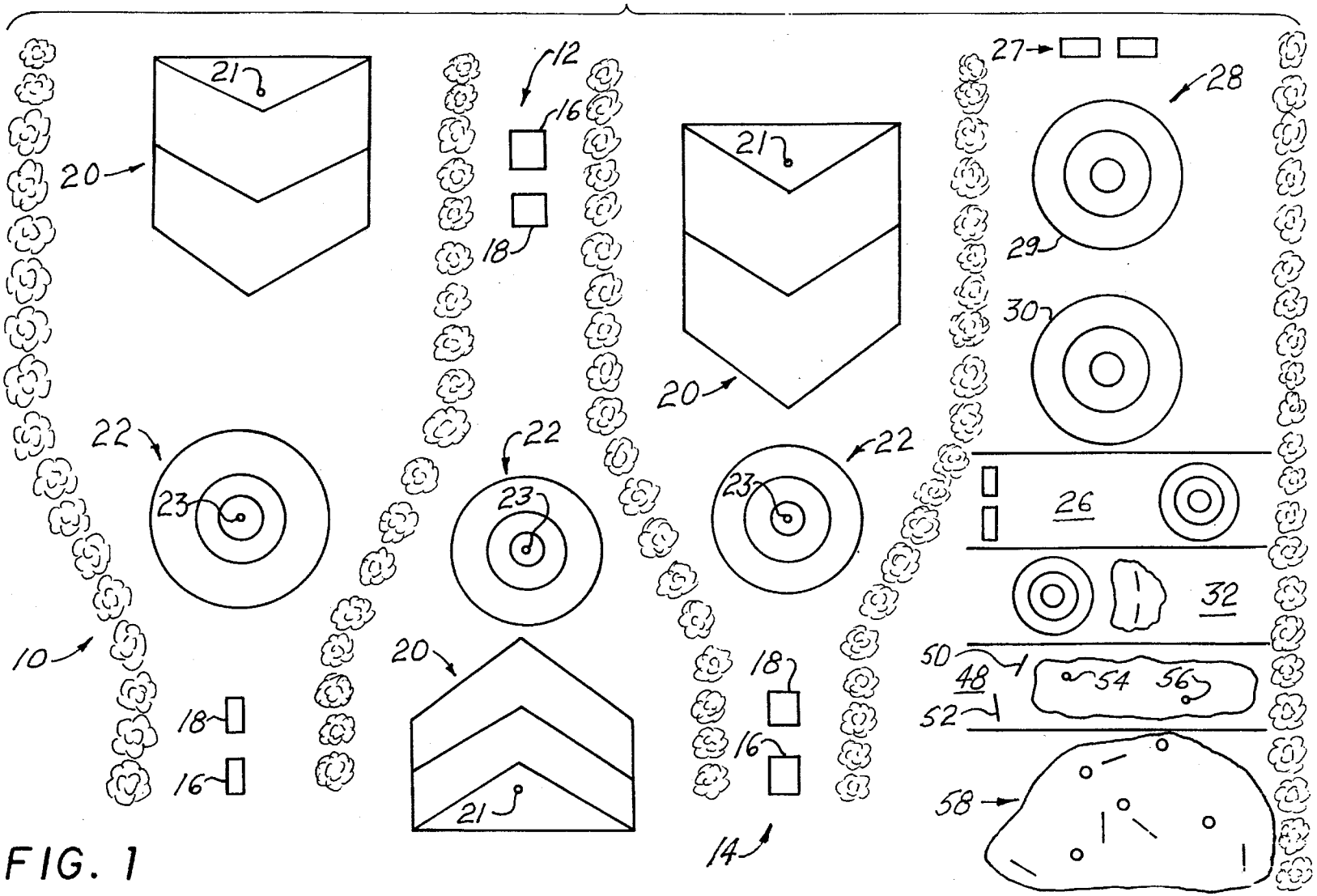
FIG. 1 is a topographical plat or top plan view of a golf course layout according to the instant invention.
Figure 2:
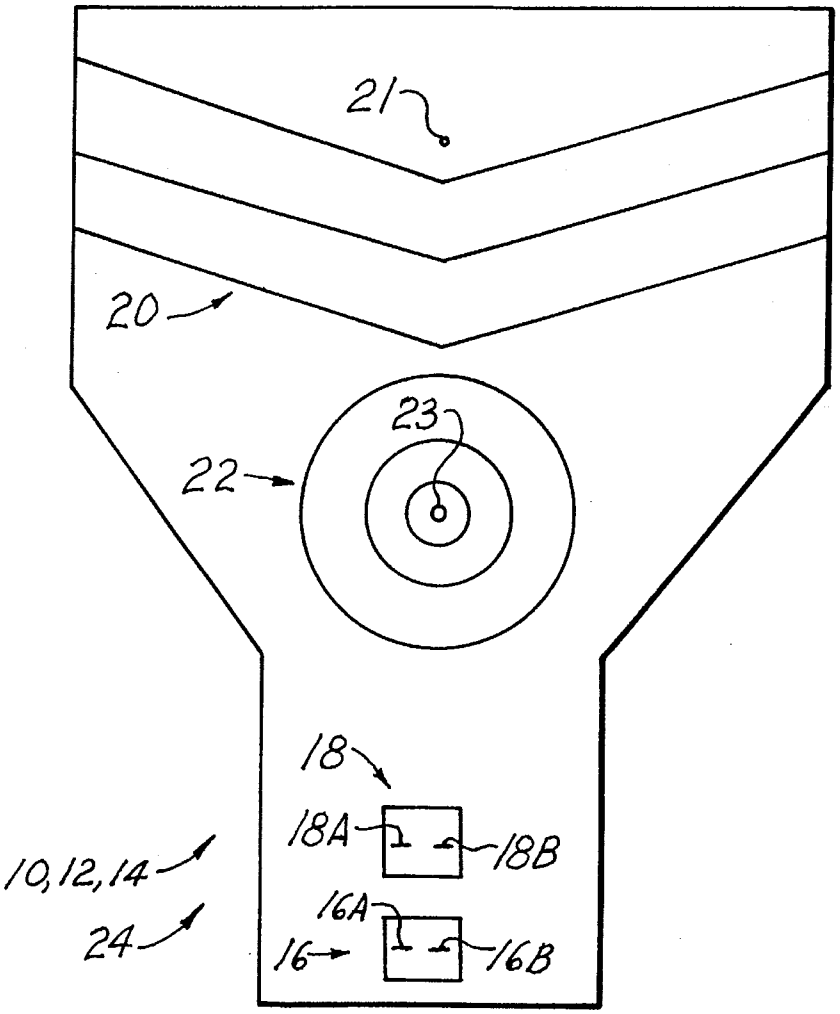
FIG. 2 is a top plan view of a restricted distance and width driving target with a 125 yard bullseye target, according to the invention.

The last hole on the course is a putting course 58 of five holes, as shown at the lower right hand side of FIG. 1 and in FIG. 5. Putting positions and holes are shown in FIG. 5, with possible lines of travel of ball to hole, to clarify the figure. Scoring is 4 for holing out, 3 for two putts, 2 for three putts, and 1 for four putts. Par is 5 times 3 or 15.

With reference to FIG. 7, a scorecard is indicated wherein seven of the eight holes are played. Two players "Dave" and "Roy" have played a round and recorded their scores. The scorecard is color coded in blue, yellow and green, as is shown in FIG. 7, blue for the long game, yellow for the intermediate game, and green for the short game. The target line is graphic and letter coded for chevron target, bullseye target, chip (or pitch) and putt. The first four holes are the long holes 10, 12, 14 and 24, previously described, and numbered "1" through "8" since two targets were played on each of the four holes. Next is the double bullseye hole 28, or holes "8" and "9" since two targets were played on each hole. Next comes the sand and pitch hole 32, or holes "11" and "12" since each player plays from four positions on this hole. Next is the chip and pitch hole 48 which translates to holes "13" through "16" on the scorecard. Finally, there is the putting course 58 with its five holes, or those marked "17" through "21" on the scorecard. Just a simple glance at the scorecard shows that Dave did better than Roy, it being remembered that the higher the score, the better the play in this invention. Equally importantly, the scorecard shows that the two players are about even in the long game, Roy being only two shots behind Dave. However, Roy's intermediate and short games need work, as Roy lost four shots to Dave in each of these categories.

It is to be understood that the present invention is not limited to the embodiments described above, but encompasses any and all embodiments within the scope of the following claims.

I claim:

1. A golf game comprising a golf course laid out with long distance and short distance holes and a putting course:

said long distance holes comprising a predetermined plurality of long distance holes, each including two teeing areas and a longer distance driving target and a shorter distance bullseye target;

at least one short distance hole including two teeing areas and at least one bullseye target; and a putting course with a putting green, a predetermined order of play, and a predetermined number of holes.

2. The golf game as claimed in claim 1, wherein said long distance holes are at least three in number, each driving target being chevron configured and including three distinct driving scoring zones, each bullseye target including a hole centered within three distinct bullseye target scoring areas, said bullseye target areas being situated intermediate of said teeing areas and said driving scoring zones.

3. The golf game as claimed in claim 2, wherein each said two teeing areas are located one in front of the other with respect to said driving and bullseye targets.

4. The golf game as claimed in claim 2, wherein the width of each long distance hole is about twice as wide in the vicinity of said driving target as the width of said long distance hole in the vicinity of said two teeing areas.

5. The golf game as claimed in claim 1, wherein there are four of said long distance holes, the distance between the said teeing areas, bullseye targets and driving targets of the four holes being different.

6. The golf game as claimed in claim 1, there being two of said short distance holes, a first of said short distance holes including two bullseye targets located one in front of the other with respect to said two teeing areas, a second of said short distance holes including a single bullseye target.

7. The golf game as claimed in claim 6, wherein said two teeing areas of both said short distance holes are positioned side by side, and thus about equidistant from said bullseye targets.

8. The golf game as claimed in claim 1, further comprising a sand shot hole including a sand trap having two predetermined shot positions defined therein and a bullseye target spaced therefrom.

9. The golf game as claimed in claim 8, said sand shot hole further being provided with two sand traps, each having a shot position defined therein, and two additional, pitch shot positions, each being located outside of both said sand traps and said sand shot hole bullseye target.

10. The golf game as claimed in claim 1, further comprising a chip and putt hole including a chip and putt green, two holes positioned on said chip and putt green, and two pairs of shot positions located a predetermined distance outside of said chip and putt green.

11. The golf game as claimed in claim 1, wherein said putting course includes a putting green of predetermined size and configuration, a plurality of putting holes located on said putting green, and a corresponding plurality of putting positions for each putting hole.

12. The golf game as claimed in claim 11, wherein said number of putting holes and corresponding putting positions is five in number.

13. The golf game as claimed in claim 1, wherein a scoring system is provided including the play by each player of two balls on each long distance and short distance hole of the course with a number score assigned to the accuracy of the shot of each ball, the more accurate the shot, the higher the score, the said putting course being played with one ball by each player, a number score being assigned to each putt, the fewer the number of putts, the higher the score.

14. The golf game as claimed in claim 1, the number of holes being eight including the said putting course, there being four of said long distance holes, a short distance hole including two bullseye targets, a sand and pitch shot hole including sand traps having two predetermined shot positions defined therein and a bullseye target spaced therefrom, and additional pitch shot positions located adjacent said sand and pitch hole bullseye target, and a chip and putt hole including a chip and putt green, two holes positioned on said chip and putt green, and two pairs of shot positions located a predetermined distance outside of said chip and putt green, and said putting course including a putting green of predetermined size and configuration, a plurality of putting holes located on said putting green, and a corresponding plurality of putting positions for each putting hole, said number of putting holes and corresponding putting positions being five in number.

15. A golf game comprising a golf course laid out with long distance and short distance holes and a putting course:

said long distance holes comprising a predetermined plurality of long distance holes, each including two teeing areas and a longer distance driving target and a shorter distance bullseye target;

at least one short distance hole including two teeing areas and at least one bullseye target; and a putting course with a putting green, a predetermined order of play, and a predetermined number of holes;

the number of holes being eight including the said putting course, there being four of said long distance holes, a first short distance hole including two bullseye targets, a sand and pitch shot hole including sand traps having two predetermined shot positions defined therein and a bullseye target spaced therefrom, and a chip and putt hole including a chip and putt green, two holes positioned on said chip and putt green, and two pairs of shot positions located a predetermined distance outside of said chip and putt green, and said putting course including a putting green of predetermined size and configuration, a plurality of putting holes located on said putting green, and a corresponding plurality of putting positions for each putting hole, said number of putting holes and corresponding putting positions being five in number; and a scoring system being provided including the play by each player of two balls on each long distance and short distance hole of the course with a number score assigned to the accuracy of the shot of each ball, the more accurate the shot, the higher the score, the said putting course being played with one ball by each player, a number score being assigned to each putt, the fewer the number of putts, the higher the score.

16. The golf game as claimed in claim 15, said sand shot hole further being provided with two additional, pitch shot positions, each being located outside of both said sand traps and said sand shot hole bullseye target.

* * * * *

UNITED STATES PATENT AND TRADEMARK OFFICE

CERTIFICATE OF CORRECTION

PATENT NO. : 5,490,671
DATED : February 13, 1996
INVENTOR(S) : Roy W. Picard

It is certified that error appears in the above-indentified patent and that said Letters Patent is hereby corrected as shown below:

On the title page,
Item [54] should read "TARGET GOLF COURSE AND GAME", instead of "TARGET GOLD COURSE AND GAME".

Signed and Sealed this
Sixteenth Day of July, 1996

*Attest:*

*Attesting Officer*

BRUCE LEHMAN

*Commissioner of Patents and Trademarks*